US007770246B2

(12) United States Patent
Chen

(10) Patent No.: US 7,770,246 B2
(45) Date of Patent: Aug. 10, 2010

(54) FOLDABLE BED

(76) Inventor: Libin Chen, Qiaoyu building, West of Boyi Town, Changzhou, Jiangsu Province (CN) 213147

( * ) Notice: Subject to any disclaimer, the term of this patent is extended or adjusted under 35 U.S.C. 154(b) by 189 days.

(21) Appl. No.: 11/987,688

(22) Filed: Dec. 4, 2007

(65) Prior Publication Data

US 2009/0139026 A1 Jun. 4, 2009

(51) Int. Cl.
*A47C 19/04* (2006.01)

(52) U.S. Cl. ..... 5/111; 5/116; 5/117
(58) Field of Classification Search ..... 5/99.1, 5/110, 111, 112, 116, 117
See application file for complete search history.

(56) References Cited

U.S. PATENT DOCUMENTS

| | | | | |
|---|---|---|---|---|
| 7,712 | A * | 10/1850 | Whitmarsh | 5/115 |
| 6,705,234 | B1 * | 3/2004 | Miller et al. | 108/36 |
| 2004/0000009 | A1 * | 1/2004 | Choi | 5/174 |
| 2008/0295246 | A1 * | 12/2008 | Yul et al. | 5/12.2 |

* cited by examiner

*Primary Examiner*—Peter M. Cuomo
*Assistant Examiner*—William Kelleher

(57) ABSTRACT

A foldable bed having a frame and a cover attached to the frame. The frame has two handles, two identical side beams each having a pair of groove beams pivotally connected to one of the handles, connectors and bars pivotally connected to the handles or the connectors. The foldable bed is able to be folded by a simple action of pulling the handle upward meanwhile stepping on the peddling member. And it is able to be expanded by a simple action of breaking off the two groove beams with two hands of a user. Furthermore, the foldable bed occupies relatively small storing space when folded since a width of the folded bed is much shorter than that of the expanded one's.

4 Claims, 4 Drawing Sheets

FOLDABLE BED

BACKGROUND OF THE INVENTION

1. Field of the Invention

The invention relates to a foldable bed, and more particularly, to a foldable bed which is able to be folded and expanded easily and occupy relatively small storing space.

2. Description of the Prior Art

Foldable beds have long been developed since they are easily conveyed and occupies smaller space when folded. However, conventional foldable beds are still not satisfactory for two main reasons. First, an operation of folding and expanding is not simple enough: it often needs two hands of a user or sometimes even two users. Second, the volume of the folded bed is still not small enough: an area thereof is often at least a half of the whole bed.

BRIEF SUMMARY OF THE INVENTION

The main object of the invention is to provide a foldable bed which is able to be folded and expanded easily. It is able to be folded by a simple action of pulling a handle thereof upward meanwhile stepping on a step thereof with one foot. And it is able to be expanded by a simple action of breaking off two beams thereof with two hands of a user.

Another object of the invention is to provide a foldable bed which occupies relatively small storing space when folded. A width of the folded bed is much shorter than that of the expanded one's.

In order to accomplish the above objects, the present invention provides a foldable bed having:

a frame having two handles, two identical side beams each having a pair of groove beams pivotally connected to one of the handles, a first connector contained in a groove of each groove beam, a leg pivotally connected to each groove beam through the first connector, four first side bars each pivotally connected to one of the handles with one end thereof and to an lower end of the leg, four second side bars each pivotally hinged together with one of the first side bars, two second connectors each pivotally connecting two lower ends of the two second side bars of one side of the foldable bed, four third connectors each covering on and being slidable along one of the first side bars, four fourth connectors each fixed on one of the second side bars between the second connector and the hinge point of the second bar, four third side bars each pivotally connected to the third connector with one end thereof and to the fourth connector with a free end thereof, four fifth connectors each fixed at a free end of the second side bar, four fourth side bars each pivotally connected to the fifth connector with one end thereof and to the first connector with a free end thereof, two first middle bars each pivotally connected to a free end of the groove beam with one end thereof and to a fifth connector of an opposite side with a free end thereof, two opposite first middle bars each pivotally connected to a free end of the groove beam with one end thereof and to the fifth connector with a free end thereof, the first and the opposite first middle bars being hinged at about a middle portion thereof, two second middle bars each pivotally connected to the handle with one end thereof and to one of the fourth connector of an opposite side with a free end thereof, and two opposite second middle bars each pivotally connected to the handle with one end thereof and to one of the fourth connectors with a free end thereof, the second and the opposite second middle bars being hinged at about a middle portion thereof; and, a cover attached to the frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
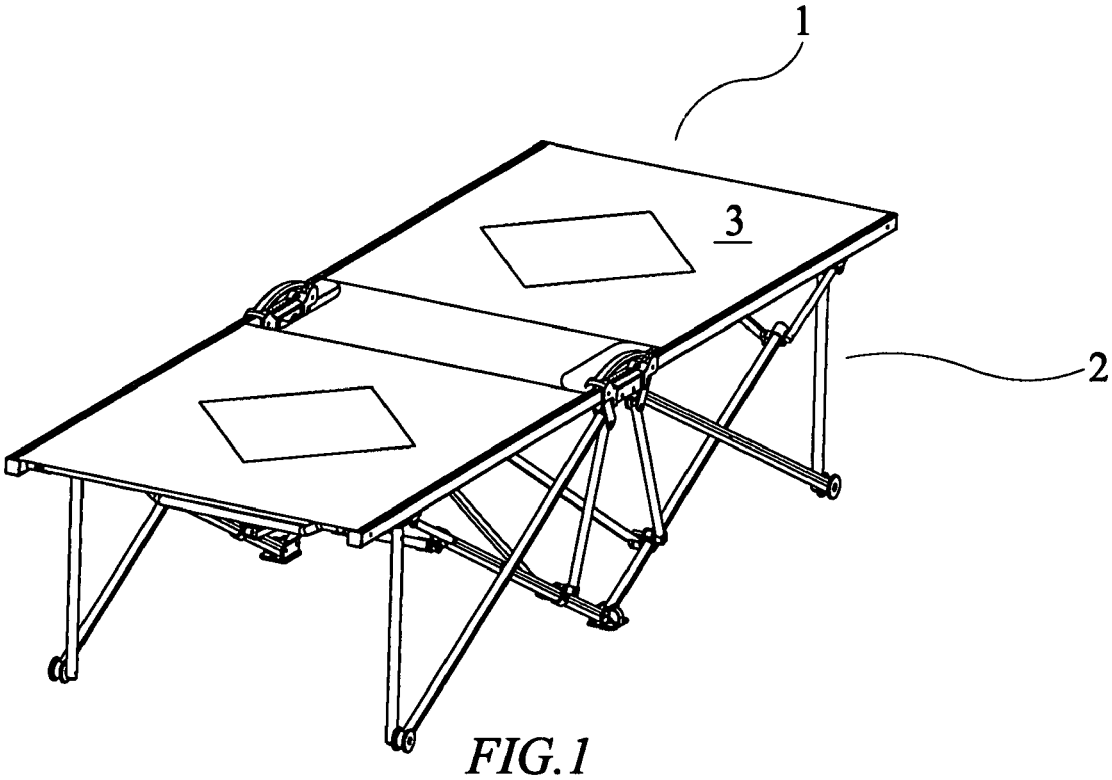
FIG. 1 is a perspective view of the preferred embodiment of a foldable bed of the invention.

With reference to FIG. 1, it is a perspective view the preferred embodiment of a foldable bed 1 of the invention, showing a status of the foldable bed 1 when it is expanded. The foldable bed 1 has a frame 2 and a cover 3 attached to the frame 2. The cover 3 acts as bedplate as the foldable bed 1 is expanded.

Figure 2:
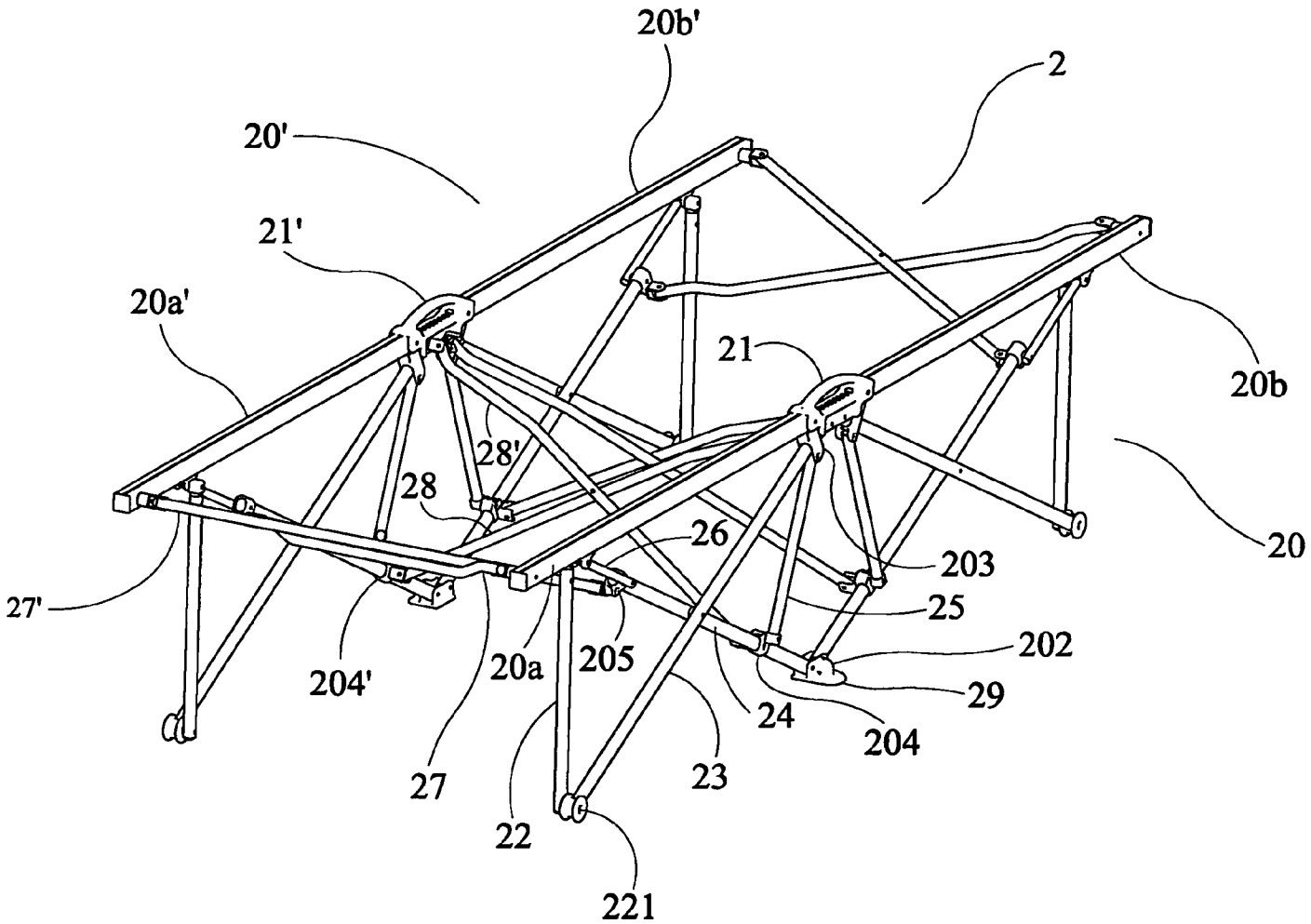
FIG. 2 is a perspective view of a frame of the foldable bed shown in FIG. 1.
Figure 3:
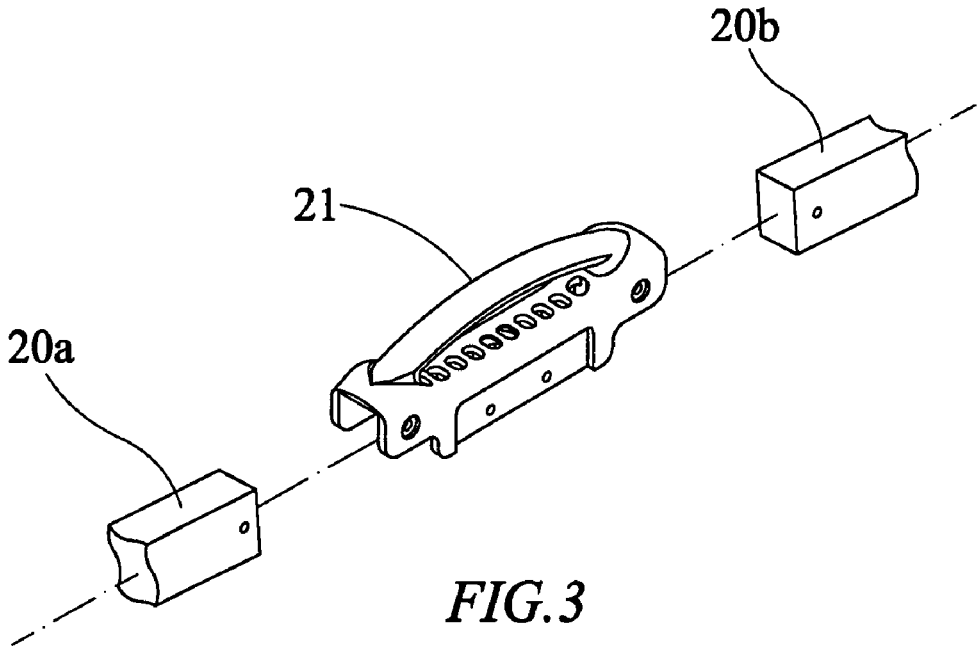
FIG. 3 is a perspective view of a handle of the foldable bed shown in FIG. 1.
Figure 4:
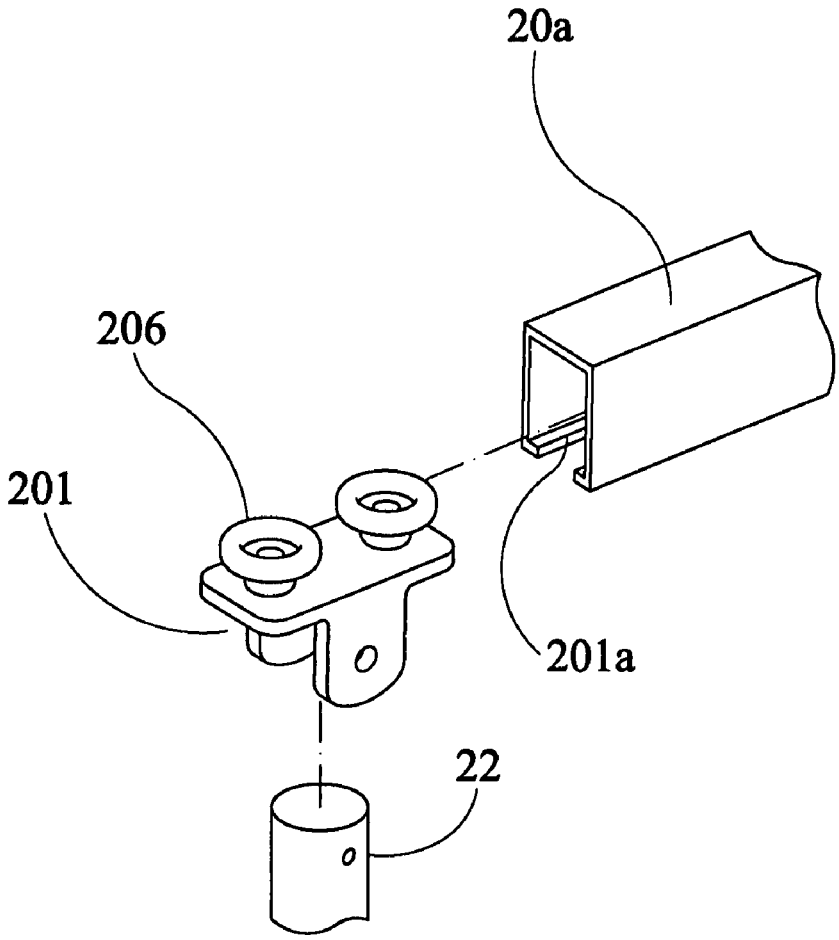
FIG. 4 is a perspective view of a first connector of the foldable bed shown in FIG. 1; and, FIG. 5 is a side view of the foldable bed shown in FIG. 1 showing a status of being folded.

As shown in FIG. 2, the frame 2 has two identical side beams 20, 20'. Each side beam 20 or 20' has a pair of groove beams 20*a*, 20*b* or 20*a*', 20*b*' pivotally connected by a handle 21 or 21', as particularly shown in FIG. 3. As the foldable bed 1 of the invention is longitudinally and transverse symmetric, only one groove beam 20*a* will be described hereinafter. Together with reference to FIG. 4, a leg 22 is pivotally connected to the groove beam 20*a* through a first connector 201 near a free end of the groove beam 20*a*. The first connector 201 has at least one head 206 contained in a groove 201*a* of the groove beam 20*a* allowing the first connector 201 being able to slide with respect to the groove beam 20*a*. A first side bar 23 is pivotally connected to the handle 21 with one end thereof and to an lower end of the leg 22 with a free end thereof. A roller 221 may be provide at the lower end of the leg 22 thus making the foldable bed 1 of the invention easy to be pushed to move. A second side bar 24 is pivotally hinged together with the first side bar 23. Two lower ends of the two second side bars 24 of one side of the foldable bed 1 are pivotally connected to a second connector 202. A third connector 203 covers on and is able to slide along the first side bar 23. A fourth connector 204 is fixed on the second side bar 24 at a position between the second connector 202 and the hinge point of the second bar 24. A third side bar 25 is pivotally connected to the third connector 203 with one end thereof and to the fourth connector 204 with a free end thereof. A fifth connector 205 is fixed at a free end of the second side bar 24. A fourth side bar 26 is pivotally connected to the fifth connector 205 with one end thereof and to the first connector 201 with a free end thereof.

A first middle bar 27 is pivotally connected to a free end of the groove beam 20*a* with one end thereof and to a fifth connector (not shown) of an opposite side with a free end thereof. An opposite first middle bar 27' is pivotally connected to a free end of the groove beam 20*a*' with one end thereof and to the fifth connector with a free end thereof. The first and the opposite first middle bars 27, 27' are hinged at about the middle portion thereof. A second middle bar 28 is pivotally connected to the handle 21 with one end thereof and to a fourth connector 204' of an opposite side with a free end thereof. An opposite second middle bar 28' is pivotally connected to the handle 21' with one end thereof and to a fourth connector 204 with a free end thereof. The second and the opposite second middle bars 28, 28' are hinged at about the middle portion thereof. A peddling member 29 may be provided on the second connector 202 on which a user is able to step with a foot.

Figure 5:
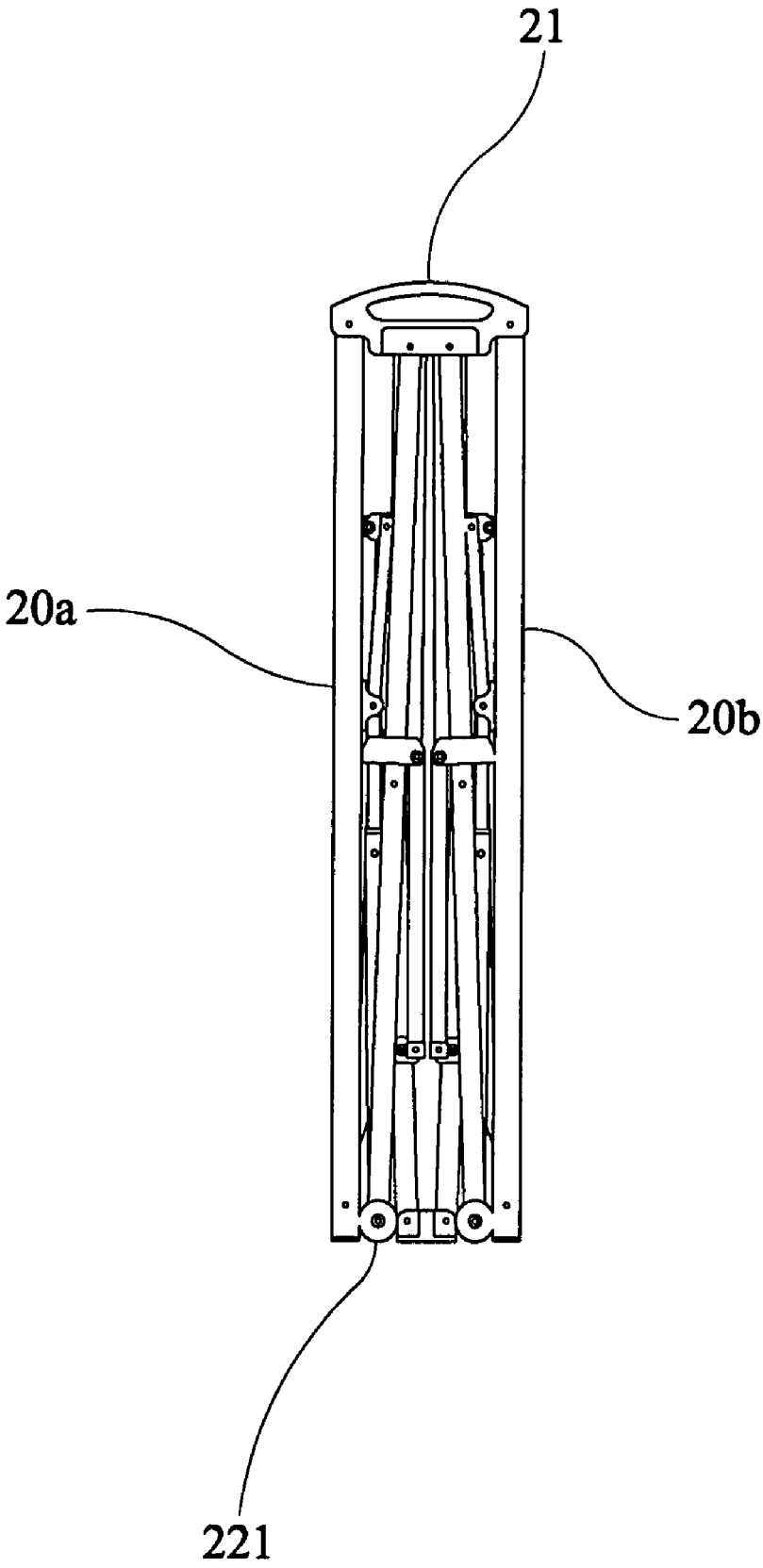

When a user needs to fold the foldable bed 1 of the invention, he is able to step on the peddling member 29 with one of his foot and then pull the handle 21 upward. The first side bar 23 will be pulled to upward accordingly and the roller 221 and the leg 22 will move towards a direction of the handle 21 and the second connector 202. Meanwhile, the third connector 203 moves downward along the third side bar 25, the fifth connector 205 moves towards the groove beam 20*a*, and the first connector 201 moves along the groove beam 20*a* towards the handle 21. At the same time, an upper end of the second middle bar 28 is also pulled to go upward and the opposite first middle bar 27' is pulled by the fifth connector 205 to move roughly along the groove beam 20*a* towards the handle 1. These makes the opposite sides of the foldable bed 1 moves towards each other. With reference to FIG. 5, by keeping pulling the handle 21, the foldable bed 1 of the invention is able to be finally folded as shown. In expansion, the user is able to just break off the groove beams 20*a*, 20*b* with his two hands and the foldable bed will be easily expanded to a status shown in FIGS. 1 and 2.

From above description, it could be seen that the foldable bed 1 is able to be folded by a simple action of pulling the handle 21 upward meanwhile stepping on the peddling member. And it is able to be expanded by a simple action of breaking off the two groove beams 20*a*, 20*b* with two hands of a user. Furthermore, the foldable bed 1 occupies relatively small storing space when folded since a width of the folded bed is much shorter than that of the expanded one's.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable bed comprising:

a frame having two handles, two identical side beams each having a pair of groove beams both pivotally connected to one of said handles, a first connector contained in a groove of each said groove beam, a leg pivotally connected to each said groove beam through said first connector, four first side bars each pivotally connected to one of said handles with one end thereof and to a lower end of one of said legs, four second side bars each pivotally hinged together with one of said first side bars, two second connectors each pivotally connecting two lower ends of two of said second side bars of one side of said foldable bed, four third connectors each covering on and being slidable along one of said first side bars, four fourth connectors each fixed on one of said second side bars between one said second connector and one hinge point of said second bar, four third side bars each pivotally connected to a respective said third connector with one end thereof and to a respective said fourth connector with a free end thereof, four fifth connectors each fixed at a free end of each said second side bar, four fourth side bars each pivotally connected to a respective said fifth connector with one end thereof and to a respective first connector with a free end thereof, two first middle bars each pivotally connected to a free end of a respective said groove beam with one end thereof and to a fifth connector of an opposite side with a free end thereof, two opposite first middle bars each pivotally connected to a free end of a respective said groove beam opposite to said groove beams connecting to said first middle bars with one end thereof and to a fifth connector of the other side with a free end thereof, said first and said opposite first middle bars being hinged at about a respective middle portion thereof, two second middle bars each pivotally connected to a respective said handle with one end thereof and to one of said fourth connectors of the other side with a free end thereof, and two opposite second middle bars each pivotally connected to a respective said handle with one end thereof and to one of said fourth connectors of the other side with a free end thereof, said second and said opposite second middle bars being hinged at about a respective middle portion thereof; and, a cover attached to the frame.

2. The foldable bed as claimed in claim 1, wherein a peddling member is provided on each of said second connectors.

3. The foldable bed as claimed in claim 1, wherein a roller is provided at a lower end of each said leg.

4. The foldable bed as claimed in claim 2, wherein a roller is provided at a lower end of each said leg.

* * * * *